US009851098B2

(12) United States Patent
Kim

(10) Patent No.: US 9,851,098 B2
(45) Date of Patent: Dec. 26, 2017

(54) SWIRLER

(71) Applicant: Hanwha Techwin Co., Ltd., Changwon-si (KR)

(72) Inventor: Ik Soo Kim, Changwon-si (KR)

(73) Assignee: Hanwha Techwin Co., Ltd., Changwon-Si (KR)

( * ) Notice: Subject to any disclaimer, the term of this patent is extended or adjusted under 35 U.S.C. 154(b) by 0 days.

(21) Appl. No.: 14/911,811

(22) PCT Filed: Apr. 2, 2014

(86) PCT No.: PCT/KR2014/002816
§ 371 (c)(1),
(2) Date: Feb. 12, 2016

(87) PCT Pub. No.: WO2015/023042
PCT Pub. Date: Feb. 19, 2015

(65) Prior Publication Data

US 2016/0195266 A1 Jul. 7, 2016

(30) Foreign Application Priority Data

Aug. 12, 2013 (KR) ..... 10-2013-0095604

(51) Int. Cl.
*B05B 7/10* (2006.01)
*F23D 11/38* (2006.01)
(Continued)

(52) U.S. Cl.
CPC ..... *F23D 11/383* (2013.01); *B05B 7/04* (2013.01); *B05B 7/0458* (2013.01); *B05B 7/10* (2013.01);
(Continued)

(58) Field of Classification Search
CPC ..... F23D 14/04; F23D 11/383; F23D 7/004; F23D 11/004; F23D 11/40; F23D 11/44;
(Continued)

(56) References Cited

U.S. PATENT DOCUMENTS 5,423,173 A 6/1995 Lemon et al.
6,543,235 B1 * 4/2003 Crocker ..... F23C 9/006 60/742
6,986,255 B2 * 1/2006 Smith ..... F23R 3/343 60/737
(Continued)

FOREIGN PATENT DOCUMENTS

EP 0 561 591 A2 9/1993
EP 2 618 059 A2 7/2013
JP 59-215518 A 12/1984

OTHER PUBLICATIONS

Communication dated Jul. 3, 2014 issued by the International Searching Authority in counterpart International Patent Application No. PCT/KR2014/002816 (PCT/ISA/220, PCT/ISA/210, PCT/ISA/237).

*Primary Examiner* — Steven J Ganey
(74) *Attorney, Agent, or Firm* — Sughrue Mion, PLLC

(57) ABSTRACT

The inventive concept relates to a swirler. According to an aspect of the inventive concept, there is provided a swirler including a casing, a pilot body disposed in the casing, and a plurality of vanes arranged along a circumference of the pilot body, wherein at least a part of the vane protrudes further to a downstream than an end portion of the pilot body.

4 Claims, 10 Drawing Sheets

(51) Int. Cl.

| | |
|---|---|
| ***F23D 3/14*** | (2006.01) |
| ***F23D 7/00*** | (2006.01) |
| ***B05B 7/04*** | (2006.01) |
| ***F23D 14/04*** | (2006.01) |
| ***F23D 11/00*** | (2006.01) |
| ***F23R 3/14*** | (2006.01) |
| ***F23D 11/40*** | (2006.01) |
| ***F23C 7/00*** | (2006.01) |
| ***F23D 14/24*** | (2006.01) |
| ***F23D 11/44*** | (2006.01) |

(52) U.S. Cl.

CPC ..... *F23C 7/004* (2013.01); *F23D 3/14* (2013.01); *F23D 7/00* (2013.01); *F23D 11/004* (2013.01); *F23D 11/40* (2013.01); *F23D 11/44* (2013.01); *F23D 14/04* (2013.01); *F23D 14/24* (2013.01); *F23R 3/14* (2013.01)

(58) Field of Classification Search

CPC ... F23D 14/24; F23D 3/14; F23D 7/00; B05B 7/10; B05B 7/04; B05B 7/0458; F23R 3/14; F23C 7/004

USPC .... 239/403, 405, 406, 418, 419, 419.5, 433, 239/434; 60/737, 742, 748, 39.463

See application file for complete search history.

(56) References Cited

U.S. PATENT DOCUMENTS

| | | | | |
|---|---|---|---|---|
| 7,540,154 | B2 * | 6/2009 | Tanimura | F23D 17/002 60/742 |
| 2010/0058767 | A1 | 3/2010 | Simons et al. | |

* cited by examiner

SWIRLER

TECHNICAL FIELD

The inventive concept relates to a swirler.

BACKGROUND ART

A swirler is used as a flame stabilizer of a pressure atomizing-type oil burner or a high pressure gas current atomizing-type oil burner, and swirls the air introduced into a burner by using swirl vanes. A mixture gas of the air introduced into the burner by the swirler and a fuel generates negative pressure in a center portion, and accordingly, generates a high temperature low-speed circulation region that may be ignited.

Swirlers may be classified as axial flow swirlers and radial flow swirlers.

FIG. 1 is a partially cut perspective view schematically showing an axial flow swirler, as an example of an axial flow swirler. In addition, FIG. 2 is a cross-sectional view of the axial flow swirler of FIG. 1, wherein a side of the axial flow swirler based on a symmetric axis is shown. Referring to FIGS. 1 and 2, an axial flow swirler 10 includes a plurality of vanes 12 that are disposed on an upstream side of a burner 50 on a path of air GA entering a chamber 51 of the burner 50. The plurality of vanes 12 are radially arranged on a boundary of a pilot body 15 to be inclined with respect to an entering path of the air GA so as to change a flow direction of the air entering the chamber 51 of the burner 50. Therefore, the air and the fuel mixed with the air are introduced into the burner while generating a whirlpool.

Such an axial flow swirler has a simple structure and is easy to be manufactured. However, because only a direction of introduction fluid is changed without changing a velocity of the introduction fluid, the performance of mixing the air and the fuel may degrade.

FIG. 3 shows an example of a radial flow swirler and schematically shows a cross-sectional side of the radial flow swirler based on a symmetric axis. A radial flow swirler 20 is disposed at an upstream side of a burner 50 like the axial flow swirler 10, and includes a pilot body 25 and a plurality of vanes 22 coupled to the pilot body 25. Unlike the axial flow swirler 10, in the radial flow swirler 20, the air GA is introduced into the chamber 51 of the burner 50 in a radial direction while a flow direction and velocity of the air are rapidly changed by the vanes 22.

As described above, the radial flow swirler is excellent in view of mixing the air and the fuel due to the rapid change in the velocity of the introduced air, but it is difficult to manufacture the radial flow swirler and to control the flow of fluid, compared to the axial flow swirler.

DETAILED DESCRIPTION OF THE INVENTIVE CONCEPT

Technical Problem

The inventive concept provides a swirler having excellent performance in mixing air and a fuel and stabilizing a flame, having less pressure drop, and is easy to be manufactured and maintained.

Technical Solution

According to an aspect of the inventive concept, there is provided a swirler including a casing, a pilot body disposed in the casing, and a plurality of vanes arranged along a circumference of the pilot body, wherein at least a part of the vane protrudes further to a downstream than an end portion of the pilot body.

Advantageous Effects

According to an aspect of the inventive concept, a swirler has excellent performance in mixing air with a fuel and stabilizing a flame, less pressure drop, and is easy to be manufactured and maintained.

BEST MODE

Figure 1:
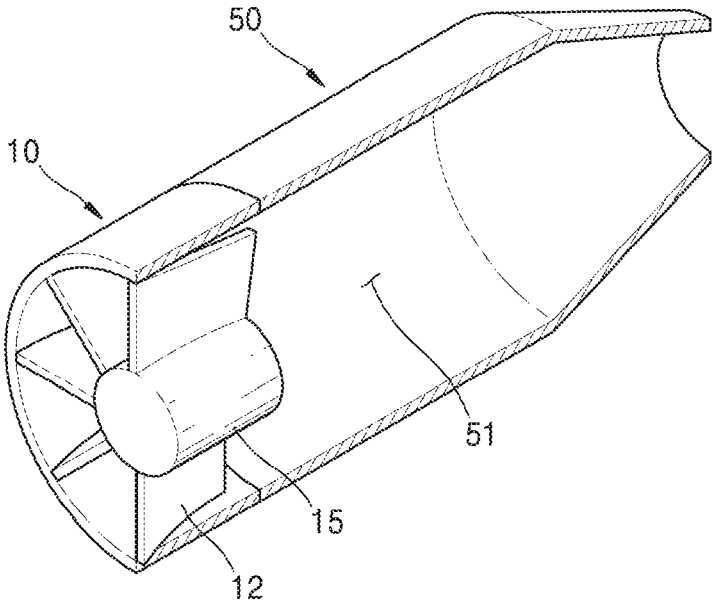
RELATED ART FIG. 1
FIG. 1 is a partially cut perspective view of an axial flow swirler according to prior art.
Figure 2:
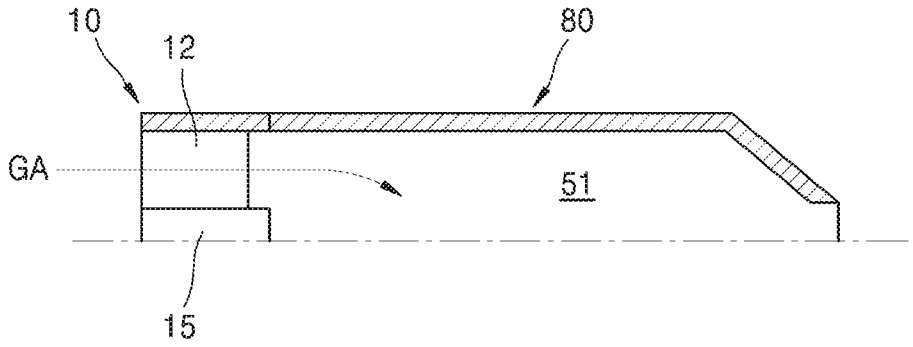
RELATED ART FIG. 2
FIG. 2 is a schematic cross-sectional view showing a side of the axial flow swirler of FIG. 1 based on a symmetric axis.
Figure 3:
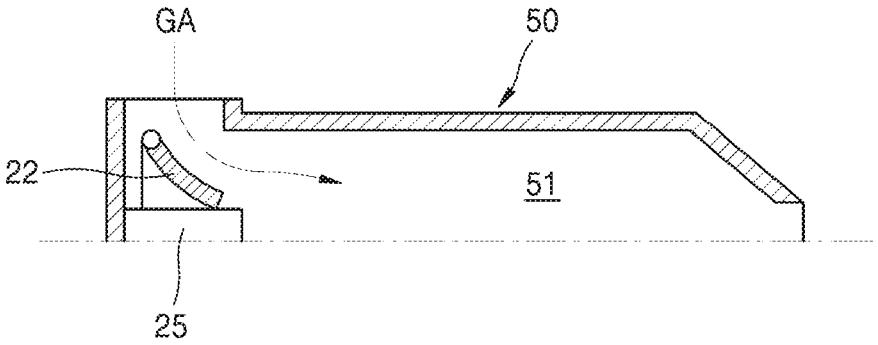
RELATED ART FIG. 3
FIG. 3 is a schematic cross-sectional view showing a side of a radial flow swirler according to prior art, based on a symmetric axis.

According to an aspect of the inventive concept, there is provided a swirler including a casing, a pilot body disposed in the casing, and a plurality of vanes arranged along a circumference of the pilot body, wherein at least a part of the vane protrudes further to a downstream than an end portion of the pilot body.

The casing may comprise an inlet portion and an outlet portion, and an expansion portion having an increasing inner diameter between the inlet portion and the outlet portion.

The vane may comprise an inclined portion that is inclined with respect to a lengthwise direction of the pilot body, and the inclined portion may be disposed inside the expansion portion.

When an angle between a corner of the vane adjacent to the casing and a radial direction of a center axis of the swirler is $\alpha$, an inclination of the vane with respect to the center axis direction of the swirler is $\beta$, and when an angle between the center axis direction of the swirler and a corner of the vane adjacent to the outlet portion of the swirler is $\theta$, the angles $\alpha$, $\beta$, and $\theta$ may satisfy following conditions, $0° < \alpha < 90°$, $30° < \beta < 60°$, $30° < \theta < 60°$.

The swirler may further comprise a plurality of atomizers coupled to the casing for atomizing a fuel of a liquid phase into flow paths between the plurality of vanes.

The swirler may further comprise a plurality of gas inlets disposed on the inlet portion of the casing for spraying a fuel of a gas phase into the flow paths between the plurality of vanes.

MODE OF THE INVENTIVE CONCEPT

A swirler will now be described more fully with reference to the accompanying drawings, in which exemplary embodiments of the inventive concept are shown. In the accompanying drawings, sizes of components may be exaggerated, omitted, or reduced for convenience of explanation. In addition, like reference numerals in the drawings denote like elements, and thus their description may be omitted.

Figure 4:
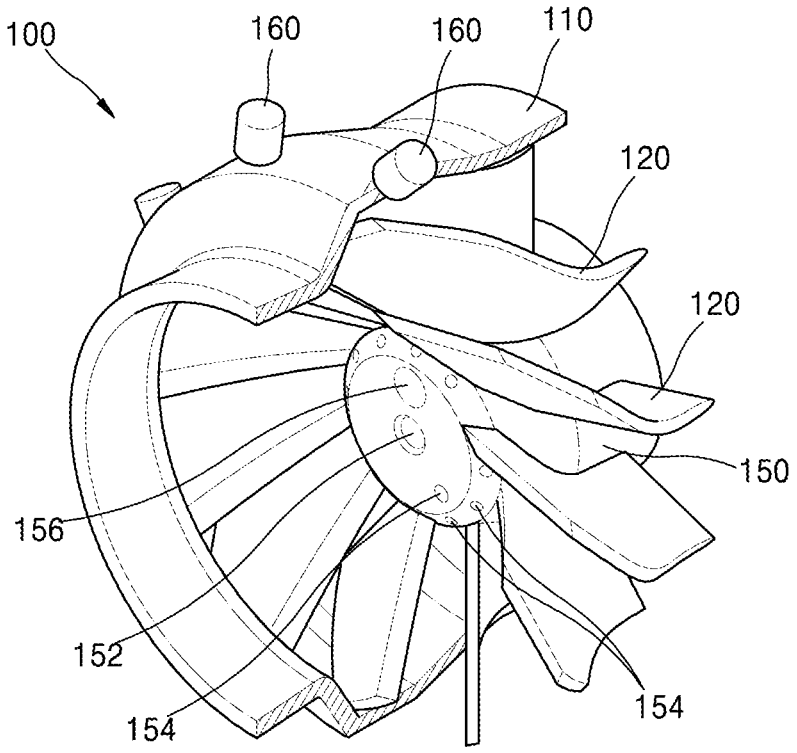
FIG. 4 is a partially cut perspective view schematically showing a swirler according to an embodiment of the inventive concept.
Figure 5:
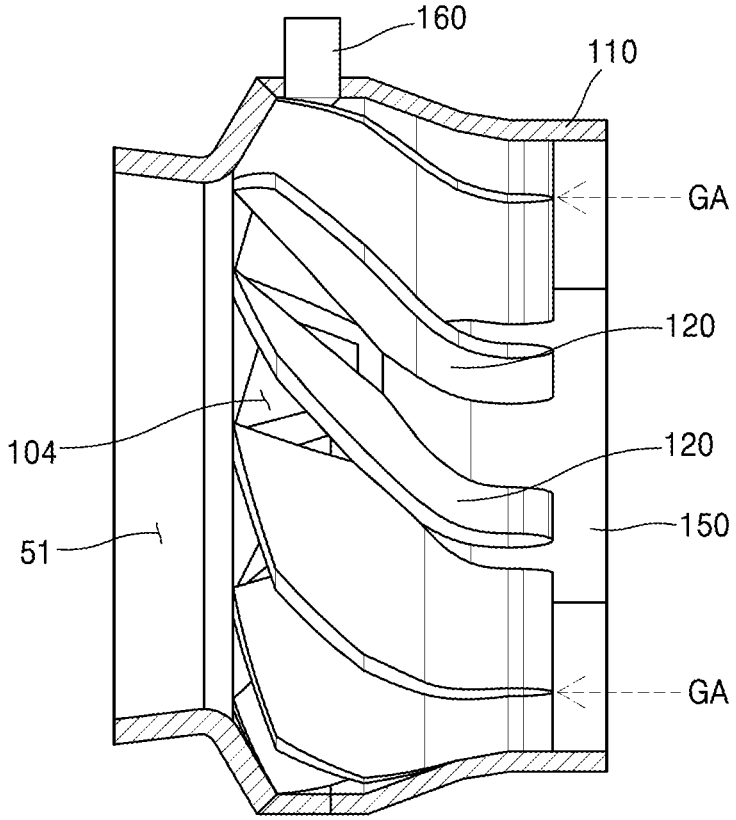
FIG. 5 is a partially cross-sectional view schematically showing an internal structure of the swirler of FIG. 4.

FIG. 4 is a partially cut perspective view of a swirler according to an embodiment of the inventive concept, and FIG. 5 is a partially cross-sectional view schematically showing an internal structure of the swirler of FIG. 4.

Referring to FIGS. 4 and 5, a swirler 100 according to the embodiment includes a casing 110, a pilot body 150, a plurality of vanes 120, atomizers 160, and gas inlets 170.

The casing 110 partitions an internal space and is in communication with a burner (not shown). The casing 110 includes an inlet through which the air is introduced and an outlet through which the air is discharged. The air introduced through the inlet changes its flow direction while passing through the vanes 120 that are fixedly arranged in the casing 110, and then, is discharged after passing through a pre-chamber 51 to be introduced into the burner that is connected to a downstream side of the swirler 100.

The pilot body 150 ignites an air/fuel mixture gas and stabilizes a flame sufficiently, and extends in direction of a center axis of the swirler 100 in an internal space of the casing 110. A pilot atomizing device 152, a gas pilot 154, and an igniter 156 are disposed at an end portion of the pilot body 150 adjacent to the burner. The pilot atomizing device 152 atomizes a fuel of a liquid phase into a combustion chamber of the burner, and the gas pilot 154 atomizes a fuel of a gas phase into the combustion chamber of the burner. As such, by atomizing the fuel of the liquid phase or the fuel of the gas phase into the combustion chamber by using the pilot atomizing device 152 and the gas pilot 154, the flame in the burner may be maintained effectively. The gas pilot 154 may include a plurality of gas outlet holes, some of which may be formed in a flat end portion of the pilot body 150 and some other of which may be along a periphery of the pilot body 150 at constant intervals therebetween. The number and a location of the gas pilot 154 are not limited thereto, but may be modified variously. The igniter 156 performs ignition so that a combustion reaction of the air/fuel mixture gas may occur. An end portion of the pilot body 150 toward the burner may be inclined.

The vanes 120 are arranged along a periphery of the pilot body 150 with constant intervals and inclined with respect to a direction of introducing the air GA so as to change the flow direction of the air GA.

Figure 6:
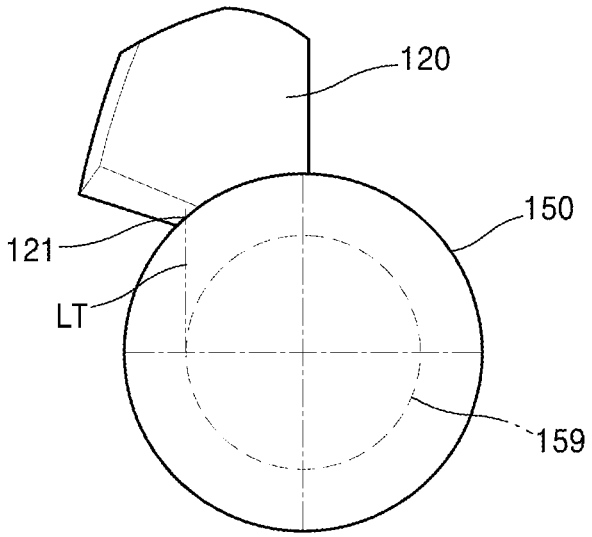
FIG. 6 is a schematic diagram showing a coupling shape of vanes to a pilot body in the swirler of FIG. 4, as seen from a front portion of the pilot body.
Figure 7:
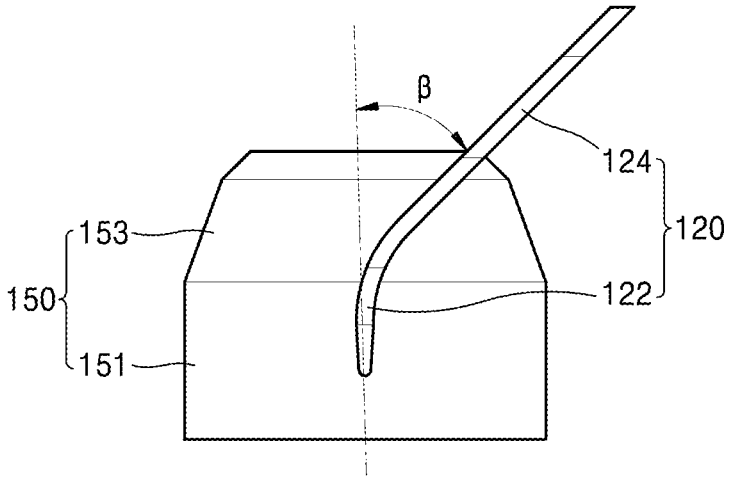
FIG. 7 is a schematic diagram showing a coupling shape of the vanes to the pilot body in the swirler of FIG. 4, as seen from a side of the pilot body.

FIGS. 6 and 7 are schematic diagrams showing one vane 120 coupled to the pilot body 150 in order to describe a shape of coupling the vanes 120 to the pilot body 150, as respectively seen from a front portion and a side portion of the pilot body 150.

Referring to FIGS. 6 and 7, the pilot body 150 includes a cylinder portion 151, and an inclined end portion 153 at an end portion of the cylinder portion 151 and to be inclined. Also, the vane 120 includes a base portion 122 coupled to the cylinder portion 151 of the pilot body 150 and extending in a lengthwise direction of the pilot body 150, and an inclined portion 124 extending from the base portion 122 and inclined with respect to the lengthwise direction of the pilot body 150, that is, a center axis of the swirler, at an angle of β. The inclined portion 124 is coupled to the inclined end portion 153 of the pilot body 150. In addition, referring to FIG. 6, a contact point LT between the inclined portion 124 of the vane 120 and the pilot body 150 is located on a tangent to a virtual pilot body 159 of a cylindrical shape located inside the pilot body 150. The other vanes 120 are also coupled to the pilot body 150 in the same manner as above. The inclined portion 124 of the vane 120 protrudes from the pilot body 150 toward a pre-chamber 51. Therefore, spaces 104 are defined between inclined portions of the plurality of vanes.

Figure 8:
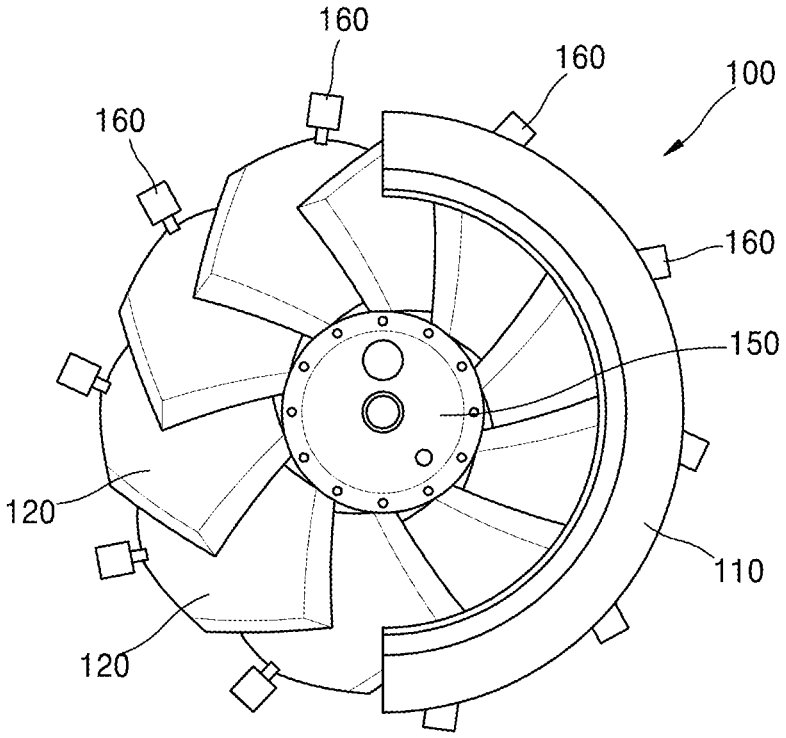
FIG. 8 is a schematic diagram partially showing the inside of the swirler of FIG. 4.

Each of the atomizers 160 is a device for atomizing the fuel of the liquid phase in the form of fine droplets to the introduced air GA in order to mix the air GA introduced into the swirler 100 with the fuel of the liquid phase. FIG. 8 is a diagram showing the swirler 100 according to the embodiment seen from a fluid outlet side, and the casing 110 is divided into halves so that the arrangement of the atomizers 160 may be clearly shown. Referring to FIG. 8, the atomizers 160 are arranged along an external periphery of the casing 110 at constant intervals, and between the vanes so as to atomize the fuel to the flow paths between the vanes 120. Also, the atomizers 160 may not be perpendicular to an external side surface of the casing 110, but may be inclined with respect to the external side surface of the casing 110.

Figure 9:
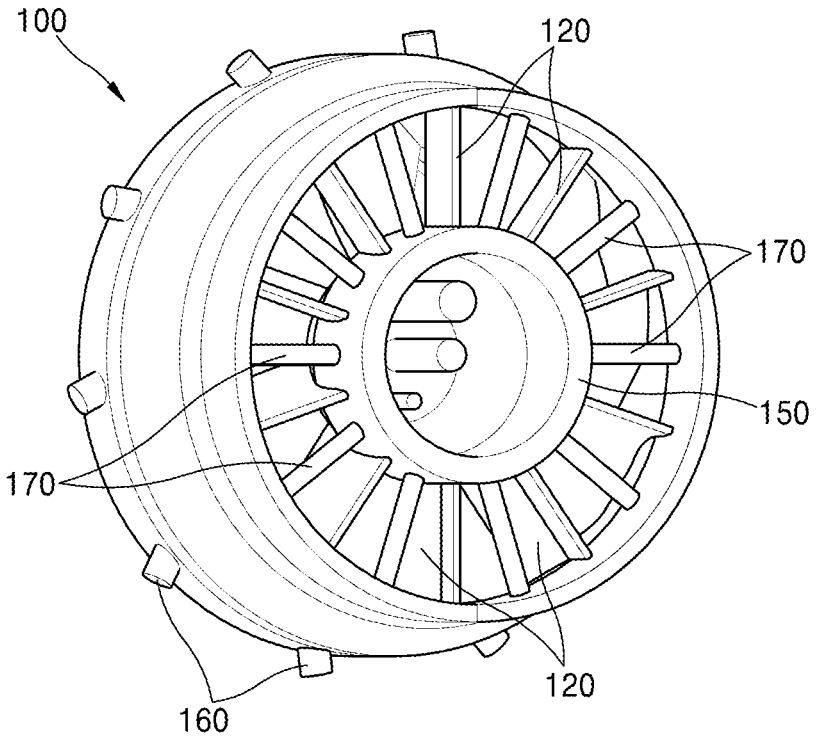
FIG. 9 is a schematic diagram showing an inlet side of the swirler of FIG. 4.

The gas inlet 170 is provided to mix the air introduced into the swirler 100 and the fuel of a gas phase. FIG. 9 schematically shows that the gas inlet 170 is disposed at an air inlet side of the swirler 100 of the embodiment. The gas inlet 170 is between every two vanes 120, and injects a fuel gas to the flow paths formed between the vanes 120. The gas inlet 170 may include a plurality of gas injection nozzles (not shown in FIG. 9) at the side of the vanes 120 in order to inject the fuel gas. One or more gas inlets 170 may be disposed between every two vanes 120. And the gas inlet 170 may be installed to overlap the vane 120 or the gas inlet 170 may be installed at the vane 120 directly.

Figure 10:
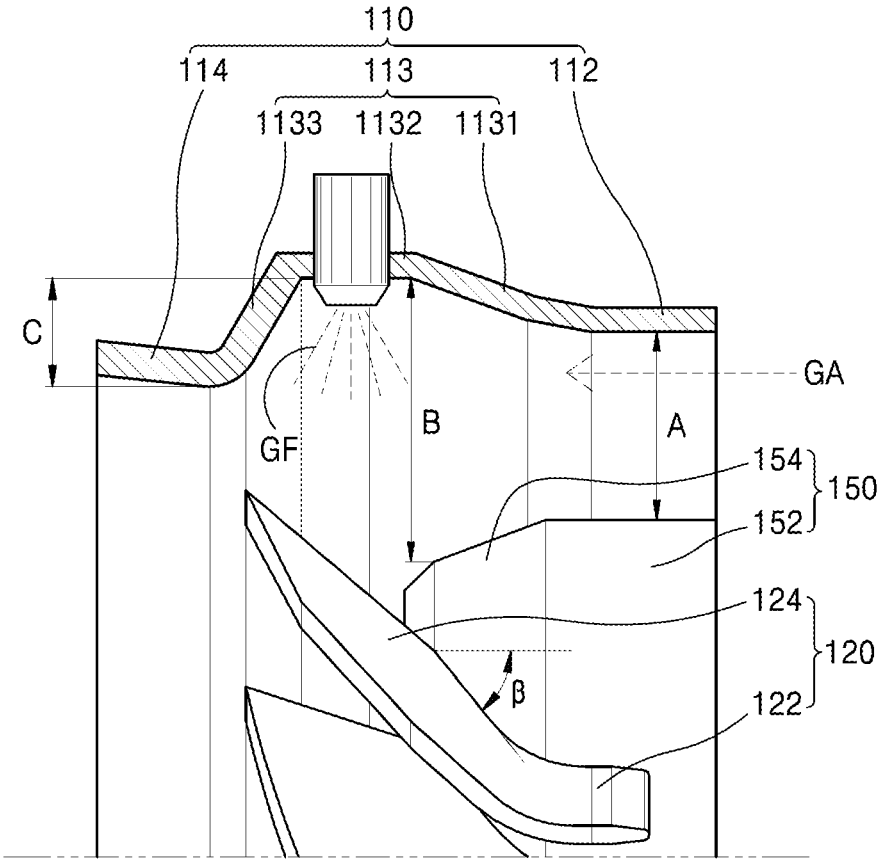
FIG. 10 is a schematic diagram showing a flow path formed inside the swirler of FIG. 4.

Next, an internal structure of the swirler 100 according to the embodiment will be described in detail below. FIG. 10 omits some of the vanes 120 so as to clearly show the flow path of the introduced air GA in the casing 110, and FIG. 11 selectively shows one vane 120 so as to clearly show the shape of the vane 120.

Figure 11:
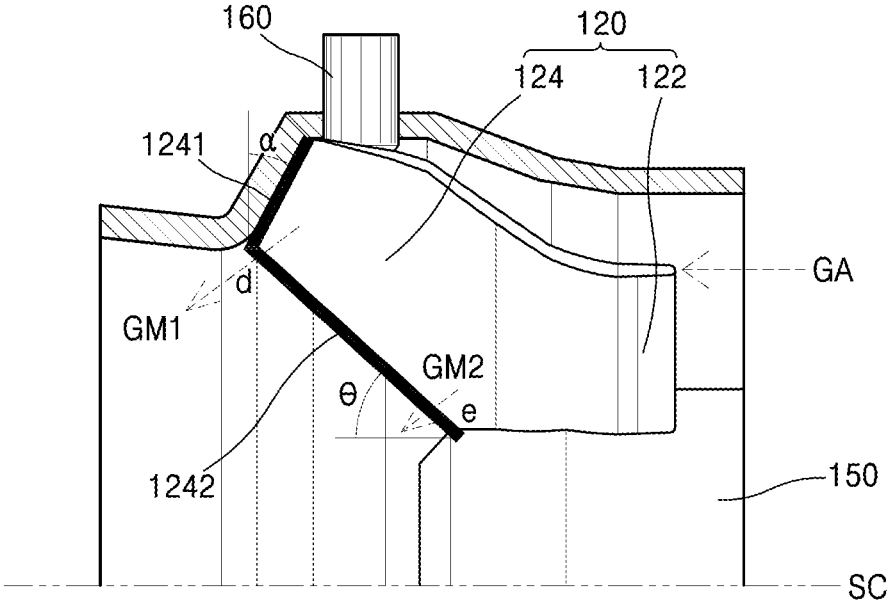
FIG. 11 is a schematic diagram showing the inside of the swirler of FIG. 4, for illustrating a shape of one vane.

Referring to FIGS. 10 and 11, the casing 110 of the swirler 100 includes an inlet portion 112, through which the air is introduced, an outlet portion 114, and an expansion portion 113 protruding outwardly while an inner diameter thereof increases between the inlet portion 112 and the outlet portion 114.

The expansion portion 113 includes a first inclined portion 1131 extending from the inlet portion 112 while being slanted, a flat portion 1132 cylindrically formed from the first inclined portion 1131 without an inclination, and a second inclined portion 1133 extending from the flat portion 1132 and being inclined while the inner diameter thereof reduces. The outlet portion 114 is connected to the second inclined portion 1133, and the inner diameter of the outlet portion 114 may increase or be constant toward a downstream.

The first inclined portion 1131 extends from around a point, where the inclined end portion 153 of the pilot body 150 starts, to around a point, where the inclined end portion 153 of the pilot body 150 ends. The vane 120 is mainly disposed in an internal space of the first inclined portion 1131 so as to occupy the internal space of the first inclined portion 1131, and reduces an effective cross-sectional area of the flow path. Thus, the internal space of the first inclined portion 1131 is expanded, compared to that of the inlet portion 112. Therefore, the effective cross-sectional area of the flow path from the inlet portion 112 to the first inclined portion 1131 may be maintained similarly. That is, the cross-sectional area of the flow path denoted by A in FIG. 10 may have a substantially similar area to that of the flow path denoted by B in FIG. 10. Also, when it is assumed that the cross-sectional area of the flow path formed over the first inclined portion 1131 is B, A and B may be substantially similar to each other. In addition, an outlet of the swirler or the portion denoted by A corresponds to limits of flashback due to a safety issue.

The flat portion 1132 and the second inclined portion 1133 are successively formed next to the first inclined portion 1131. The flat portion 1132 may provide a space where the atomizers 160 are formed. The atomizers 160 atomize the fuel of the liquid phase to make the introducing air GA and the fuel mixed together.

The second inclined portion 1133 extends to a location corresponding to an end of the vane 120, and the flow path inside the second inclined portion 1133 is formed so as to gradually reduce the cross-sectional area thereof. That is, a portion denoted by C in FIG. 10 is formed inside the second inclined portion 1133. As such, the cross-sectional area of the flow path is reduced at the C portion, and the air/fuel mixture gas escaping from the vane 120 may be accelerated.

As shown in FIGS. 10 and 11, when it is assumed that an angle between a corner 1241 of the vane 120, which is adjacent to the casing 110, and a radial direction of the center axis of the swirler is $\alpha$, an inclination of the vane 120 with respect to the center axis of the swirler 100 is $\beta$, and an angle between a direction of the center axis SC of the swirler 100 and a corner 1242 of the vane 120, which is adjacent to the outlet of the swirler 100, is $\theta$, $\alpha$, $\beta$, and $\theta$ satisfy following conditions.

$0° < \alpha < 90°$, $30° < \beta < 60°$, $30° < \theta < 60°$

In more detail, $\alpha$ may be set as about 30°, $\beta$ may be set as about 45°, and $\theta$ may be set as about 45°. Desirable ranges of $\alpha$, $\beta$, and $\theta$ may vary within a range of 10°.

According to the casing 110 and the vanes 120 designed as described above, the fluid passing through the vanes 120 ends up to have a flow velocity in a radial direction due to the portion C shown in FIG. 10, and the inclination angles of the vanes 120, that is, $\alpha$ and $\theta$, and accordingly, the fluid moves similarly to the flow passing through a radial flow swirler. That is, the fluid that has passed through the vanes 120 ends up to have the velocity in the radial direction as well, and thus, a mixing characteristic is improved.

Also, due to the C region having the reduced cross-sectional area, velocity of the fluid escaping varies from a downstream side end d of the vanes 120 to the end e of the vanes 120 adjacent to the pilot body 150, and thereby causing generation of a whirlpool and further accelerating the mixture of the air and the fuel. Therefore, the air GA introduced into the swirler 100 and the fuel GF atomized from the atomizers may be effectively mixed with each other, and stability of the flame in the chamber of the burner may be improved.

In addition, a swirler exit area of the swirler 100 can be controllable by an inclination angle of the vane 120, that is, the angles $\beta$ and $\theta$ shown in FIGS. 10 and 11, and a thickness of the vane 120. The swirler exit area of the swirler 100 can be also controllable by a diameter of the pre-chamber, and a diameter of the virtual pilot body 159 shown in FIG. 6 or the pilot body 150.

Figure 12:
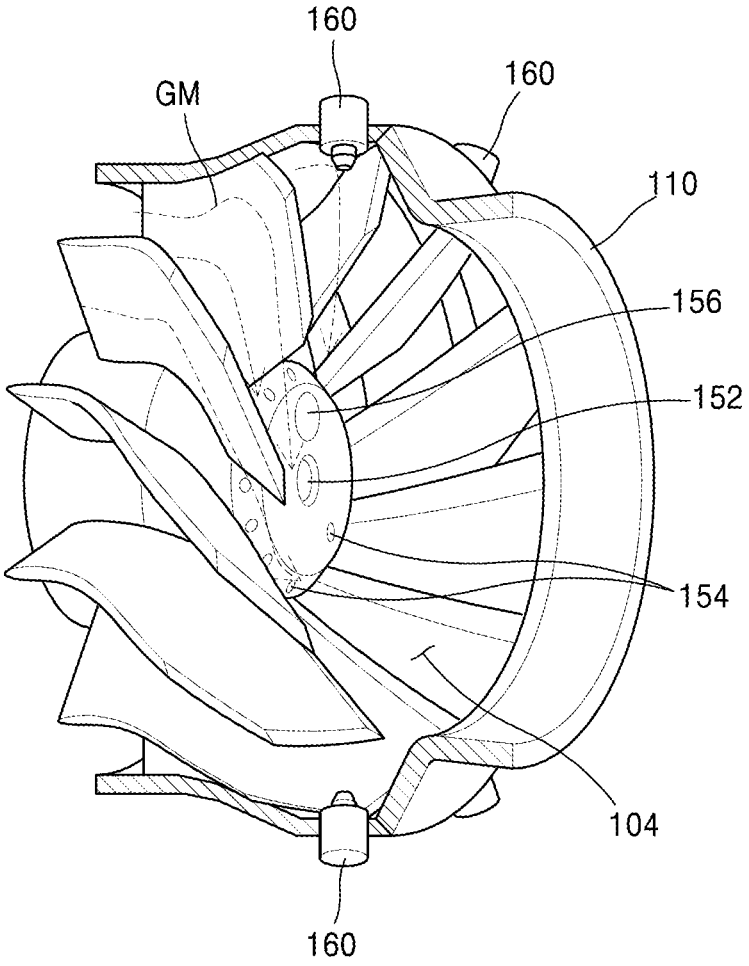
FIG. 12 is a schematic diagram showing a flow of fluid at an outlet portion of the swirler of FIG. 4.

FIG. 12 schematically shows a fluid outlet of the swirler 100, and shows a flow path of the air/fuel mixture gas GM that has passed through the vanes 120. As shown in FIG. 12, the fluid, that is, the air/fuel mixture gas GM, that has passed through the vanes 120 changes its flow path toward the center portion of the swirler 100, that is, toward the pilot body 150. Therefore, a vortex in the axial direction generated due to the escaping angle of the air/fuel mixture gas and the region C of FIG. 10 is introduced into the burner while showing a flow similar to a vortex generated due to the radial flow swirler, due to the inclination angle $\beta$ of the vanes 120. That is, the swirler according to the embodiment has a similar shape to that of the axial flow swirler so that the flow of the air/fuel mixture gas may be easily controlled and the swirler may be simply manufactured, and at the same time, the swirler may generate a large variation in the flow velocity so as to effectively improve the performance of mixing the air with the fuel like a radial flow swirler.

When a velocity of the fluid in the axial direction was simulated while varying the internal structure of the swirler 100 according to the embodiment, the velocity and recirculation of the fluid become weak when the inclination angle of the vanes 120 is small. On the other hand, when the inclination angle of the vanes 120 increases, the recirculation region of the fluid is strongly generated, but the recirculation region is far from the pilot body 150. Thus, for example, when the inclination angle $\theta$ of the vanes 120 is set as 45° and the inclination angle $\beta$ is set as 45° appropriately, the recirculation and the velocity of the fluid are very excellent.

In addition, when an equivalence ratio was simulated while varying the internal structure of the swirler 100 according to the embodiment, the mixing characteristic degraded when the escaping angle of the fluid is small. In addition, when the inclination angles of the vanes 120 are large, an excellent mixing characteristic is shown around the pilot body 150, but a cavity area CV may be formed at the center portion of the burner. For example, when the inclination angle $\theta$ of the vane 120 is set as 45° and the inclination angle $\beta$ of the vane 120 is set as 45° appropriately, the mixture of the air and the fuel may be performed sufficiently. As described above, according to the embodiment, when the inclination angle $\theta$ is 45° and the inclination angle $\beta$ is 45°, the swirler 100 generates the strong recirculation region, the velocity of the fluid is appropriate, and the excellent performance of mixing the air and the fuel is shown, according to the above numerical analysis.

The inventor of the application applied the swirler 100 of the embodiment to a different size of burner to perform computational fluid analysis. Conditions of analyzing the numerical values are shown in table below.

TABLE 1

| | | |
|---|---|---|
| Output (MWe) | 10 MWe | 220 MWe |
| Thermal output (MWt) | 26.5 MWt | 579 MWt |
| The number of cans | 6 | 16 |
| Pressure (atm) | 15 | 20 |
| Input temperature of swirler (K) | 660 | 700 |
| Flux of compressed air (kg/s) | 28 | 645 |

TABLE 1-continued

| | Target/ expected value | Numerical analysis result | Target/ expected value | Numerical analysis result |
|---|---|---|---|---|
| Turbine introduction temperature (K) | 1450 | 1434 | 1450 | 1432 |
| NOx@ 15% $O_2$-Dry (ppmv) | 8 | 7 | 10 | 18.3 |

As shown in the table above, when the swirler according to the embodiment is applied to the burner, the swirler may exhibit excellent performance in cases of both a low output burner and a high output burner.

That is, according to results of simulating an axial velocity, an equivalence ratio, a temperature, a distribution of NOx-dry, and a temperature path line when the swirler according to the embodiment is manufactured to a size of 10 MWe, the swirler according to the embodiment applied to the burner exhibited excellent performances in various fields.

In addition, according to results of simulating an axial velocity, an equivalence ratio, a temperature, distribution of NOx-dry, and a temperature path line when the swirler 100 according to the embodiment was manufactured to be suitable for a high output burner, e.g., a burner of 220 MWe, the swirler according to the embodiment exhibited excellent performances in various fields even when being applied to a high output burner.

Although the swirler according to the embodiment is described as above, one or more embodiments are not limited thereto, and the inventive concept may be implemented variously.

For example, in the above embodiment, the atomizers 160 and the gas inlets 170 are provided to use the fuel of the liquid phase and the fuel of a gas phase together, but only one of the fuels of the liquid phase and the gas phase may be used.

In addition, the atomizers and the gas inlets are provided on the pilot body 150 for maintaining the flame, but one of the atomizers and the gas inlets may not be provided on the pilot body.

Also, in the above embodiment, the casing 110 includes the expansion portion 113, but the casing 110 may not include the expansion portion. In this case, the casing 110 may be formed to have a cylindrical shape overall.

In addition, in the above embodiment, each vane 120 includes the base portion 121 and the inclined portion 123, but the vane may only include the inclined portion, without including the base portion.

Additionally, the inventive concept may be implemented in various formats.

INDUSTRIAL APPLICABILITY

The inventive concept may be used in manufacturing and utilizing a swirler.

The invention claimed is:

1. A swirler comprising:

a casing;

a pilot body disposed in the casing; and a plurality of vanes arranged along a circumference of the pilot body, wherein at least a part of each vane of the plurality of vanes protrudes further to a downstream side end than an end portion of the pilot body, wherein the casing comprises an inlet portion and an outlet portion, and an expansion portion having an increasing inner diameter between the inlet portion and the outlet portion, wherein the expansion portion includes a first inclined portion extending from the inlet portion while being slanted, a flat portion cylindrically formed from the first inclined portion without an inclination, and a second inclined portion extending from the flat portion to a location corresponding to ends of the plurality of vanes and being inclined while the inner diameter thereof reduces, and wherein a plurality of atomizers are disposed at the flat portion for atomizing a fuel of a liquid phase into flow paths between the plurality of vanes.

2. The swirler of claim 1, wherein the each vane comprises an inclined portion that is inclined with respect to a lengthwise direction of the pilot body, and the inclined portion is disposed inside the expansion portion.

3. The swirler of claim 1, wherein, when an angle between a corner of the each vane adjacent to the casing and a radial direction of a center axis of the swirler is $\alpha$, an inclination of the each vane with respect to the center axis direction of the swirler is $\beta$, and when an angle between the center axis direction of the swirler and a corner of the each vane adjacent to the outlet portion of the swirler is 0, the angles $\alpha$, $\beta$, and $\theta$ satisfy following conditions, $0° < \alpha < 90°$, $30° < \beta < 60°$, $30° < \theta < 60°$.

4. The swirler of claim 1, further comprising a plurality of gas inlets disposed on the inlet portion of the casing for spraying a fuel of a gas phase into the flow paths between the plurality of vanes.

* * * * *